US006637394B2

(12) United States Patent
Marshall et al.

(10) Patent No.: US 6,637,394 B2
(45) Date of Patent: Oct. 28, 2003

(54) SYSTEM AND METHOD FOR VEHICLE ENGINE CRANKING

(75) Inventors: Brian P. Marshall, Fort Wayne, IN (US); David V. Rodgers, Villa Park, IL (US)

(73) Assignee: International Truck Intellectual Property Company, LLC., Warrenville, IL (US)

( * ) Notice: Subject to any disclaimer, the term of this patent is extended or adjusted under 35 U.S.C. 154(b) by 53 days.

(21) Appl. No.: 09/945,272

(22) Filed: Aug. 31, 2001

(65) Prior Publication Data

US 2003/0041829 A1 Mar. 6, 2003

(51) Int. Cl.[7] ..... F01L 13/08

(52) U.S. Cl. ..... 123/179.3; 123/182.1; 123/179.16

(58) Field of Search ..... 123/179.3, 179.5, 123/179.16–179.18, 179.1, 182.1, 90.11, 481, 198 F; 701/113

(56) References Cited

U.S. PATENT DOCUMENTS

| | | | | |
|---|---|---|---|---|
| 5,117,790 A | * | 6/1992 | Clarke et al. | 123/198 F |
| 5,219,397 A | * | 6/1993 | Jones | 123/179.3 |
| 5,709,178 A | * | 1/1998 | Feucht | 123/90.12 |
| 6,357,409 B1 | * | 3/2002 | Haghgooie et al. | 123/179.3 |

FOREIGN PATENT DOCUMENTS

| | | | |
|---|---|---|---|
| DE | 19823406 A | 10/1993 | |
| JP | 58020915 A | 2/1983 | |
| JP | 05280380 A | 10/1993 | |
| JP | 10318107 A | 12/1998 | |
| JP | 11210510 A | 8/1999 | |

OTHER PUBLICATIONS

Patent Abstracts of Japan, vol. 1999, No. 13, JP 11210510A, Aug. 3, 1999, Fuji Heavy Ind. Ltd.

Patent Abstracts of Japan, vol. 1999, No. 3 & JP10318107A, Dec. 2, 1998, Mugen: KK.

Patent Abstracts of Japan, vol. 018, No. 059 & JP 05280380A, Oct. 26, 1993, Isuzu Motors Ltd.

Patent Abstracts of Japan, vol. 007, No. 098 & JP58020915A, Feb. 7, 1983, Mitsubishi Electric Corp.

* cited by examiner

*Primary Examiner*—Henry C. Yuen
*Assistant Examiner*—Arnold Castro
(74) *Attorney, Agent, or Firm*—Jeffrey P. Calfa; Neil T. Powell; Dennis Kelly Sullivan

(57) ABSTRACT

A method of boot strap starting a diesel having a plurality of cylinders comprises the steps of initiating cranking the diesel and responsive to cranking forcing exhaust valves for all cylinders open during compression strokes. Thereafter, responsive to the engine rotational speed signal exceeding a first threshold, an exhaust valve for one cylinder is allowed to open and close in synchronous with movement of a piston in the cylinder. Further responsive to engine rotational speed exceeding a second threshold higher than the first threshold, cranking is discontinued and the remaining exhaust valves are allowed to open and close in synchronous with movements of pistons in their respective cylinders.

13 Claims, 4 Drawing Sheets

SYSTEM AND METHOD FOR VEHICLE ENGINE CRANKING

BACKGROUND OF THE INVENTION

1. Field of the Invention

The present invention relates vehicle engine starting systems.

2. Description of the Problem

Designers of internal combustion piston engines have appreciated since their inception that such engines can function as pumps. Engine compression brakes exploit this aspect of engines to advantage. A compression brake operates by opening the cylinders' exhaust valves at or just before top dead center (TDC) of the pistons' cycles. Thus the energy used to compress the air in the cylinders is lost through the exhaust valves and no energy is returned to the crankshaft through the pistons during the expansion portions of the piston strokes. On motor vehicles this allows a substantial portion of an engine's rated power to be applied to braking.

Compression brake systems are implemented by installing controls for exhaust valves on many diesel engines. In one type of engine compression brake, the Jacobs engine brake, the exhaust valves are normally actuated with a standard camshaft. Normal actuation can be interrupted during braking by using energy from the injector push rod to open the exhaust valve for a cylinder at TDC of the piston. A detailed explanation of the principal of engine compression brakes, an in particular Jacobs engine brakes, may be found at pages 736–744 of Electric and Electronic Systems for Automobiles and Trucks by Robert N. Brady, Reston Publishing Company, Inc., Reston, Va. (1983).

Exhaust valve control has also been used on kick start motorcycles. Compression rebound occurring during attempts to start motorcycle engines could be dangerous to the riders. Compression rebound was caused when energy stored compressing an air mass in a cylinder was returned to the engine crankshaft during a down stroke of the piston. While less energy is returned than was put into the system compressing the air, the force can still be substantial. For that reason, prior to the widespread use automatic starters on motorcycles, some motorcycles came equipped with a manually activated valve switch, which allowed operators to roll the engine to top dead center (TDC) before attempts were made to kick start the vehicles' engines and thereby avoid compression rebound.

Another area where the pump aspects of engines has undesirable results is in starting diesel engines. Diesels, which typically do not have ignition sources inside the cylinders, rely on compression heating to bring the fuel air mixture to its flash point. During cold weather, the engine block can serve as a substantial heat sink, meaning that compression must be reasonably fast to assure that the mixture reaches the ignition temperature before the temperature drops due to heat loss to the engine and to the environment. Typically, diesels must be cranked to 100 rpm before combustion can occur. Diesels have substantially higher compression ratios than do gasoline engines and require more energy input to compress the air in the cylinders than in gasoline engines. All of these aspects of diesels make engine cranking high on transient energy consumption. Starter motor power consumption can reach 20,000 watts at −20 degrees Fahrenheit with engine manufacturers' recommended oil weights. Such power demands impose high loads on starter systems, starter motors and batteries, necessitating the use of large battery plants and large, heavy duty starter motors. Incomplete and failed combustion during cranking contributes to high levels of emissions releases during start up, particularly when the engine is cold.

The assignee of the present invention has implemented compression brakes on its diesels in a different manner than in the classic Jacobs engine brake. In the assignee's diesels, a hydraulic pump supplies engine oil at high pressure to the injectors and to exhaust valve override actuators as soon as the engine begins turning over. The exhaust valve override actuators are electronically controllable, allowing the exhaust valves to be opened at any point in the piston stroke for four stroke diesel engines.

SUMMARY OF THE INVENTION

One object of the invention is to reduce power consumption during cranking and starting of internal combustion engines.

Another object of the invention is to reduce emissions during engine starts.

Still another object of the invention is to reduce power demands on starter motors and starter motor circuitry, allowing commensurate reductions in motor size and output.

Yet another object of the invention is to reduce the size of the battery plant.

One aspect of the invention is to provide a method of boot strap starting an internal combustion engine having a plurality of cylinders. Upon initial cranking of the engine the exhaust valves for each cylinder are opened during piston compression strokes. Upon engine rotational speed reaching a first minimum threshold, the exhaust valve for one cylinder is allowed to open and close normally in synchronous with movement of a piston in the cylinder. As combustion commences in the one cylinder operating normally, the remaining exhaust valves are allowed to open and close in synchronous with movements of pistons in their respective cylinders. Also responsive to combustion in the first cylinder, cranking of the engine by the starter motor is discontinued.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
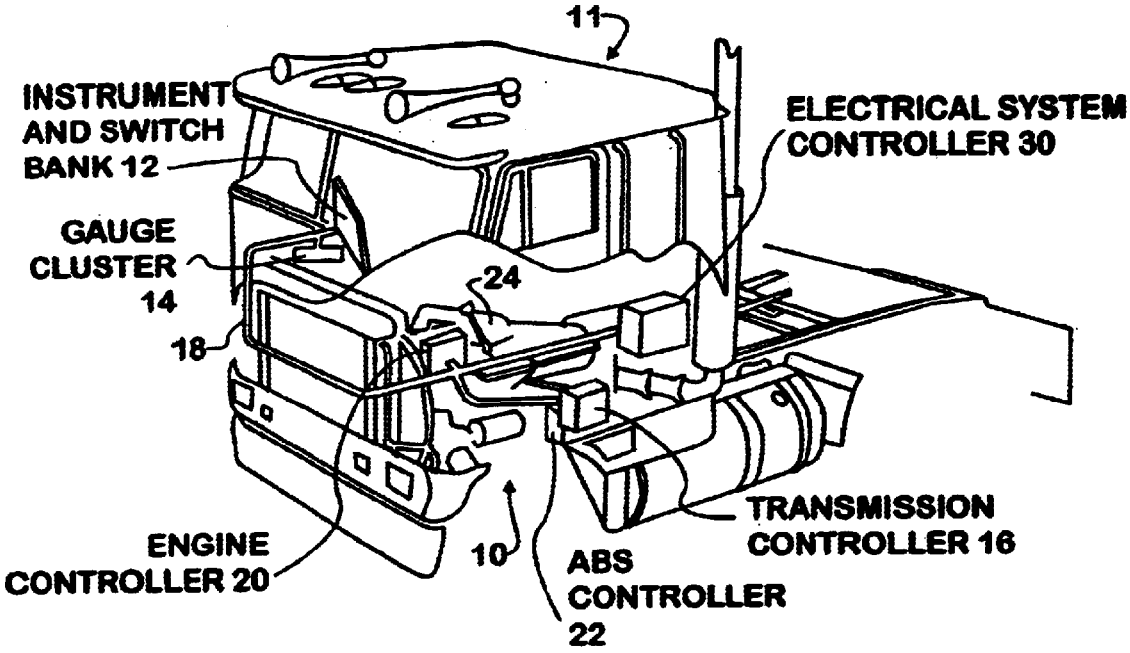
FIG. 1 is a perspective partial cutaway view of a diesel engine equipped truck tractor with which the present is advantageously employed.

FIG. 1 is a perspective view of a vehicle 11 and of an electrical control system 10 installed on the vehicle. Vehicle electrical system 10 comprises a network which may, in one embodiment, comprise a twisted pair (either shielded or unshielded) cable operating as a serial data bus 18. One node of bus 18 is an electrical system controller (ESC) 30, which is a major component of a vehicle electronic control system. ESC 30 manages a number of vocational controllers. Collectively, bus 18, ESC 30 and the vocational controllers attached thereto, form a controller area network (CAN).

Active vehicle components, such as engine 24, are typically controlled by one of a group of autonomous, programmable, vocational controllers, which include an instrument and switch bank 12, a gauge cluster 14, an engine controller 20, a transmission controller 16, and an antilock brake system (ABS) controller 22. The autonomous controllers are all connected for data communication to ESC 30 and to one another over a serial data bus 18. The autonomous controllers include local data processing and programming and are typically supplied by the manufacturer of the controlled component. For each autonomous controller there is a defined set of variables used for communications between the autonomous controller and other data processing components on the network or attached to the network. Although the autonomous controllers handle many functions locally and are functionally defined without reference to ESC 30, they report data to ESC 30 and can receive operational requests from ESC 30. Bus 18 is preferably a twisted pair cable constructed in accordance with SAE standard J1939.

Figure 2:
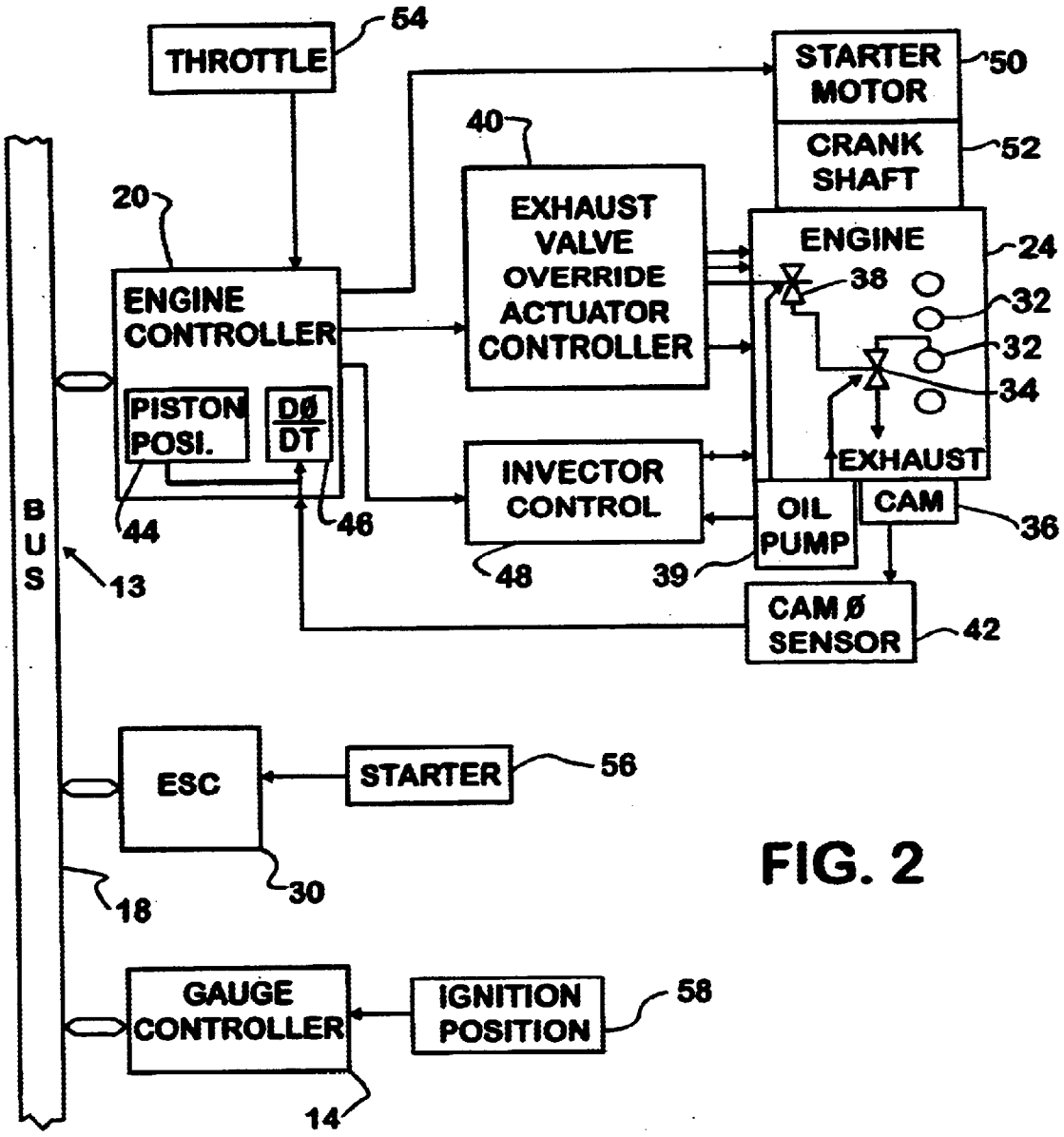
FIG. 2 is a schematic view of a vehicle electrical control system.

FIG. 2 is a schematic illustration of an electrical control system 13 for a vehicle that may be used to implement control over individual engine cylinders 32 for easing starting of engine 24 in the preferred embodiment of the invention. Engine 24 is a multiple cylinder diesel engine comprising a plurality of cylinders 32. Cylinders 32 exhaust gas containing byproducts of the combustion process through exhaust valves 34. For the sake of simplicity only one exhaust valve is shown but it will be understood that each of the cylinders 32 has its own exhaust valve 34. It will also be realized by those skilled in the art that cylinders may have more than one exhaust valve and reference to a valve for a cylinder in the singular is not intended to exclude multiple vaive per cylinder arrangements.

In normal operation exhaust valve 34 position is controlled by a camshaft 36. Camshaft 36 rotates in synchronous with crank shaft 52, which in turn is coupled to pistons (shown in FIG. 4). Camshaft 36 coordinates intake and exhaust valve positions for each cylinder 32 with piston movement in the cylinder and the stage of the intake, compression, combustion and exhaust that the cylinder is in for a four stroke engine through an hydraulic actuation system. The engine controller 20 can assume control over the exhaust valves 34 through exhaust valve override actuators 38 to open the valves at any point in the pistons' strokes. Control over the exhaust valve override actuators is provided by using high pressure engine oil from an hydraulic oil pump 39. High pressure engine oil becomes available as soon as engine 24 begins turning. During braking, fuel flow to the cylinders is cut off and exhaust valves are opened just before piston TDC in the compression strokes, in effect converting the engine into a compression pump. The result is that vehicle forward momentum, coupled through the vehicle transmission to the engine 24 crankshaft 52, is used to compress air.

The mechanism for exhaust valve control found with an engine compression brake system on a vehicle provides a convenient tool for implementing the boot strap engine starting method of the present invention. In the preferred embodiment, the invention operates by utilizing the valve control features of the assignee's engine compression brake to override valve position control by the camshaft. In engines equipped either with the assignee's engine compression brake, or in proposed engines where no mechanical camshaft is present and valve control is electronic, the invention may be implemented as software routines for exhaust valve position control. Such engines must provide an alternative indicator of piston position for the cam shaft, such as the engine crankshaft.

Boot strap starting of engine 24 begins when the engine controller 20 receives indication over the system bus 18 from electrical system controller (ESC) 30 that a start button 56 has been depressed and when gauge controller 14 indicates that the ignition position 58 is at ON. At this point, crank shaft 52 and camshaft 36 should be motionless. Cam angle position sensor 42, which provides a cam angle position signal to engine controller 20, will indicate no changes in position of the cam. A tachometer routine 46 derives an engine speed signal in rpm from the cam position signal. The cam angle position sensor is also used by a piston position determination routine 44 to determine the positions for all pistons. Throttle input 54 to the engine controller 20 is disabled.

Engine controller 20 through exhaust valve override actuator controller 40 commands the opening of all exhaust valves 34 by directing the opening of exhaust valve override actuators 38 for compression strokes of pistons. Engine controller 20 further causes starter motor 50 to begin turning crank shaft 52, which makes pressurized engine oil available. As engine oil under pressure becomes available, the exhaust valve override actuators 38 disable the hydraulic valve actuation by camshaft 36 for the compression stroke for each cylinder in turn. As engine speed reaches the minimum speed for compression combustion to begin, engine controller 20 causes exhaust valve override actuator 38 for one cylinder 32 to cease operation, allowing the exhaust valve 34 for the cylinder to operate normally. Fuel flow to the normally operating cylinder 32 is initiated through injector control 48 as timed by piston position determination 44. Typically the first minimum or threshold engine speed is about 100 rpm. This figure is a good cold start figure for ambient temperatures in the range of −20 degrees F. for an engine having the manufacturer's recommended oil for operation at such temperatures. It is possible to make the first threshold figure a function of engine oil weight, ambient temperature and engine temperature to optimize operation of the invention.

As soon as combustion begins to occur in the first cylinder 32, the exhaust valves for the remaining cylinders 32 are allowed to operate normally. Combustion is determined by engine speed reaching a second minimum threshold, for example about 375 rpm. Combustion may also be indicated by a sudden increase in engine rpm. At this point the starter motor 50 ceases cranking and cranking is taken over by the first cylinder 32.

Figure 3:
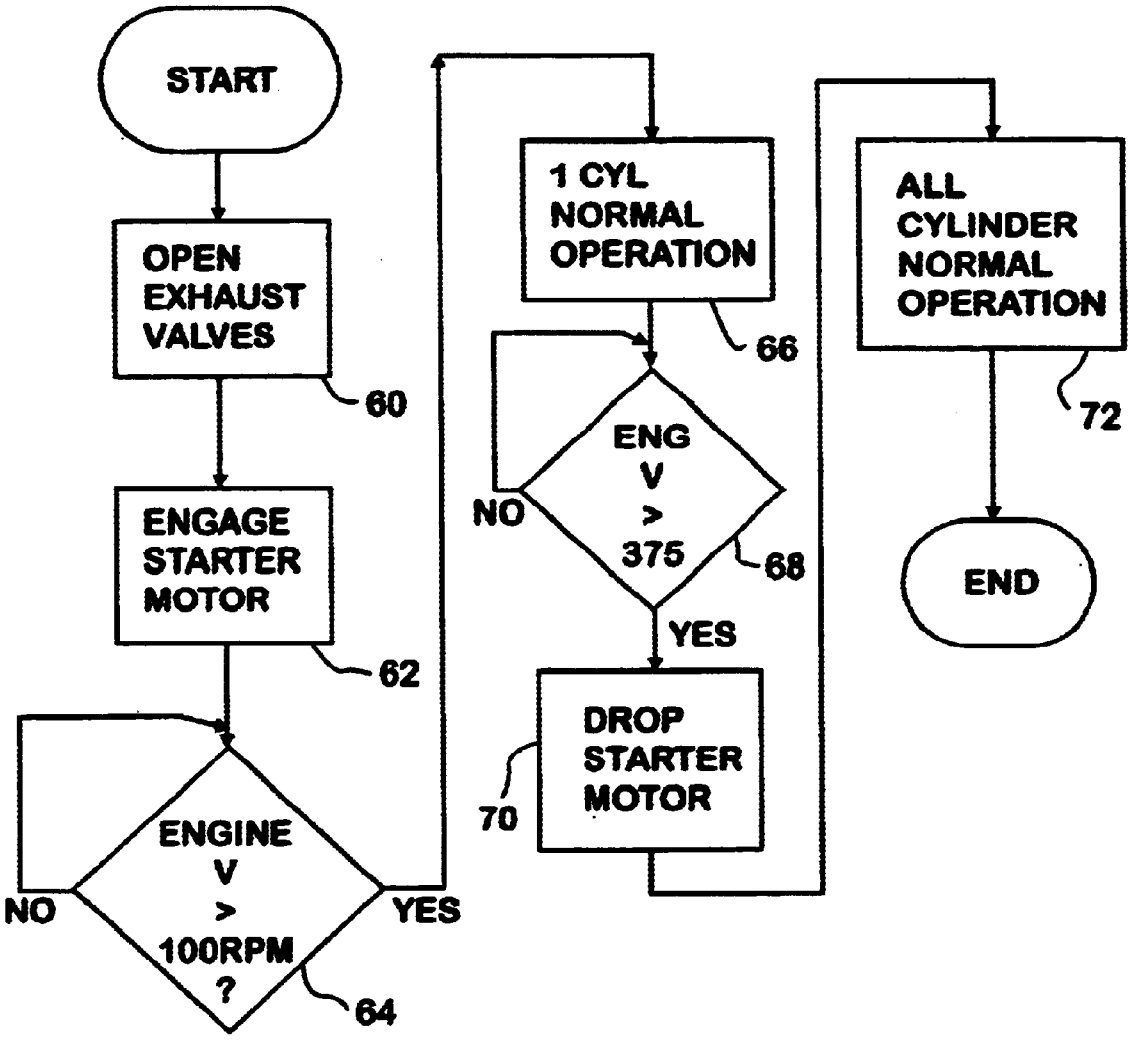
FIG. 3 is a flow chart illustrating the method of the invention.

The method of the invention is represented by a flow chart in FIG. 3. Upon start all exhaust valves are commanded to open at step 60 for compression strokes. Next, at step 62 the starter motor is engaged. Once engine speed exceeds 100 rpm, the process advances beyond decision block 64 to start normal operation of one cylinder at step 66. When combustion begins in one cylinder, engine speed will increase which is detected at step 68. With one cylinder firing the starter motor is dropped at step 70 and all cylinders are returned to normal operation at step 72. If more sophisticated electronics are available it is possible that cylinders can be brought into operation in stages.

Figure 4:
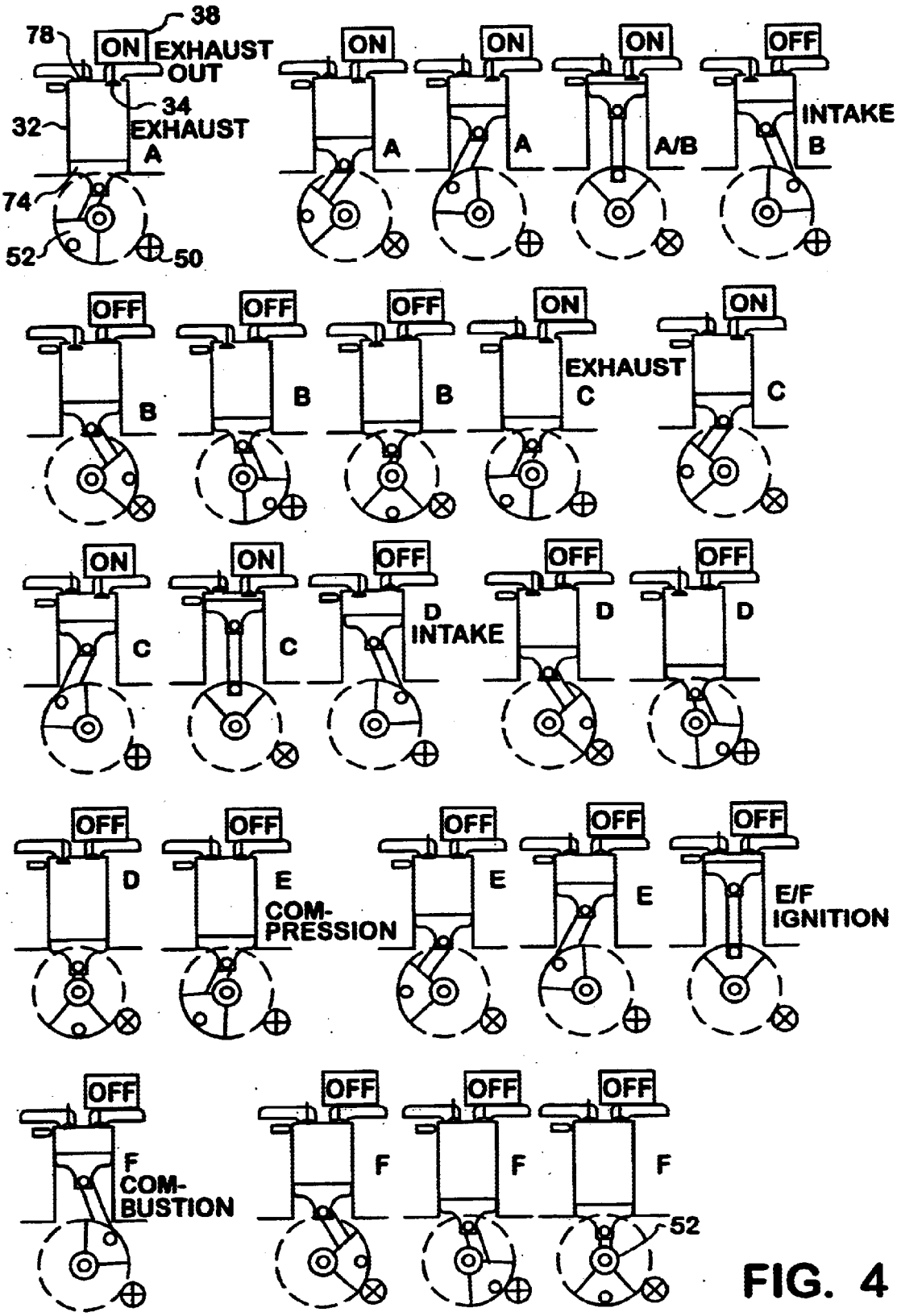
FIG. 4 is a schematic illustration of a full set of stroke cycles in a cylinder of an engine to which a preferred embodiment of the invention as been applied.

FIG. 4 illustrates movement of piston 74, intake valve 78 and exhaust valve 34 in implementing operation of the invention for a four stroke diesel engine 24. The strokes are labeled in sequence by the letters, A, B, C, D, E and F. Letter A is associated with a forced exhaust stroke during boot strap starting. Piston 74 moves upwardly in cylinder 32 in response to a crank shaft 52 turning under the influence of starter motor 50. Intake valve 78 is closed and exhaust valve 34 is open. The contents of cylinder 32 are ambient air and are exhausted. At letter B piston 74 has passed TDC and moves downwardly. Exhaust valve 34 has closed while intake valve 78 has opened. Ambient air with no fuel is drawn through intake valve 78. At letter C piston 74 has passed bottom dead center and the exhaust cycle of letter A is repeated. Letter D repeats letter B, and these cycles continue until engine rpm exceeds the first minimum threshold where upon a conventional compression stroke E and combustion stroke F occur.

The invention reduces power consumption during cranking and starting of a diesel by allowing the engine to crank up to the minimum speed required for starting without imposing the load of compressing air in the cylinders on the starter motor. Once a minimum speed is achieved a start is attempted on only one cylinder, keeping the load imposed on the starter motor to a minimum. Once combustion is achieved in that cylinder, the firing cylinder carries the load of cranking the motor until the remaining cylinders are brought into ignition. Diesels are prone to exhausting unburned and partially burned hydrocarbons during start up, which are seen as black smoke and particulate emission. The invention reduces these start up emissions by reducing the number of cylinders in which ignition is being attempted at low rpms. Once engine speeds exceed about 350 rpms, particulate emission is substantially reduced. Diesels can obtain an engine speed of 350 rpms on one cylinder operation, but providing an electrical starter motor capable of such speeds would add substantial weight and expense to vehicles. The invention avoids any need to provide an oversize starter motor and in fact, allows a smaller motor to used than is the current practice. Because less power is required for starting, the number or size of batteries used for starting may also be reduced.

While the invention is shown in only one of its forms, it is not thus limited but is susceptible to various changes and modifications without departing from the spirit and scope of the invention.

What is claimed is:

1. An internal combustion engine composing:

a plurality of combustion cylinders;

a crankshaft;

means for indicating rotational position and speed of the engine crankshaft;

an exhaust valve for each combustion cylinder;

an engine cranking system coupled to the crankshaft;

an override valve controller for interrupting normal operation of the exhaust valves and opening the exhaust valves during compression strokes; and the override valve controller being responsive to initiation of the engine cranking system for opening the exhaust valves for the combustion cylinders during compression strokes as indicated by the rotational position of the crankshaft and being further responsive to engine speed reaching a first threshold for allowing the exhaust valve for a first combustion cylinder to operate in synchronous with the crankshaft to support compression ignition in the cylinder while continuing to open the exhaust valves for at least one of the of remaining combustion cylinders during compression strokes.

2. An internal combustion engine as claimed in claim 1, further comprising;

the override valve controller being further responsive to a rate of or change in crankshaft speed indicating initiation of combustion in the first combustion cylinder for allowing the exhaust valves for the remaining combustion cylinders to operate in synchronous with the crankshaft for normal engine operation.

3. An internal combustion engine as claimed in claim 2, further comprising;

an engine controller for controlling the engine cranking system responsive to crankshaft speed indicating for shutting off operation of the engine cranking system.

4. An internal combustion engine as claimed in claim 3, further comprising:

fuel injector control which admits fuel only to combustion cylinders for which the exhaust valves are operating normally.

5. A system for controlling operability of individual cylinders of a multiple cylinder internal combustion engine, comprising:

a starter motor coupled to crank the multiple cylinder internal combustion engine;

an exhaust valve for each cylinder;

a valve controller system for opening and closing the exhaust valves synchronized with engine rotation;

a tachometer for generating an engine rotational speed signal; and a valve override system responsive to the engine rotational speed signal for overriding the valve controller system and opening any selected exhaust valve including all of the exhaust valves below given engine rotational speed thresholds during compression stroke, the valve override system being further responsive to cranking of the multiple cylinder internal combustion engine and engine rotational speed below a first threshold for forcing all exhaust valves open during compression strokes, and to engine rotational speed above the first threshold for allowing one exhaust valve to operate under the control of the valve positioning system.

6. A system as claimed in claim 5, further comprising:

the valve override system being still further responsive to engine rotational speed above a second threshold higher than the first threshold for allowing all of the exhaust valves to operate under the control of the valve positioning system.

7. A system as claimed in claim 6, further comprising:

an engine controller for controlling the starter motor being responsive to engine rotational speed above the second threshold for disengaging the starter motor.

8. A method of boot strap starting a diesel having a plurality of cylinders and a starter motor, the method comprising the steps of:

initiating cranking the diesel using the starter motor;

responsive to initiating cranking of the diesel opening exhaust valves for all cylinders during compression strokes;

generating an engine rotational speed signal for the diesel;

responsive to the engine rotational speed signal exceeding a first threshold initiating exhaust valve operation for normal four stroke operation in a first cylinder and commencing fuel injection to the first cylinder to support compression ignition in the first cylinder; and continuing to open the exhaust valves for all cylinders other than the first cylinder.

9. The method of boot strap starting a diesel as claimed in claim 8, further comprising:

responsive to indication of compression ignition occurring in a the first cylinder, initiating exhaust valve operation for four stroke operation of the remaining cylinders.

10. The method of boot strap starting a diesel as claimed in claim 9, further comprising:

further responsive to occurrence of compression ignition in the first cylinder discontinuing cranking by the starter motor.

11. A motor vehicle comprising:

a multiple cylinder internal combustion engine;

a starter motor coupled to the multiple cylinder internal combustion engine for cranking the multiple cylinder internal combustion engine;

an exhaust valve for each cylinder;

an actuable engine starterl;

a tachometer for generating an engine rotational speed signal; and a valve positioning system for opening and closing the exhaust valves in synchronous with engine rotation for four stroke operation of the multiple cylinder internal combustion engine, the valve positioning system being responsive to actuation of the actuable engine starter and to engine rotational speed signal below a first threshold for opening all exhaust valves and to engine rotational speed above the first threshold but below a second, higher threshold for causing exhaust valves for a set cylinders including some but fewer than all of the cylinders to operate normally for four stroke operation.

12. A motor vehicle as claimed in claim 11, further comprising:

the valve positioning system being still further responsive to engine rotational speed above a the second threshold higher for allowing all of the exhaust valves to operate normally for four stroke operation in the cylinder.

13. A motor vehicle as claimed in claim 12, further comprising:

an engine controller for controlling the starter motor being responsive to engine rotational speed indicative of ignition in the set of cylinders for disengaging the starter motor.

* * * * *